United States Patent [19]

Gillet

[11] 4,007,350

[45] Feb. 8, 1977

[54] PLANT FOR THE HEAT TREATMENT OF OBJECTS BY MEANS OF AN ELECTRIC FIELD

[75] Inventor: Bernard Gillet, Rosny sur Bois, France

[73] Assignee: Agence Nationale de Valorisation de la Recherche (ANVAR), Neuilly, France

[22] Filed: Jan. 16, 1975

[21] Appl. No.: 541,391

[30] Foreign Application Priority Data

Jan. 23, 1974 France ..... 74.02202

[52] U.S. Cl. ..... 219/10.81; 34/4; 34/143

[51] Int. Cl.[2] ..... H05B 9/02

[58] Field of Search ..... 219/10.81; 34/1, 4, 34/39, 143, DIG. 21; 156/272, 273, 274

[56] References Cited

UNITED STATES PATENTS

| | | | |
|---|---|---|---|
| 2,472,708 | 6/1949 | Jones, Jr. | 219/10.81 X |
| 2,529,862 | 11/1950 | Bilhuber | 34/1 |
| 2,567,983 | 9/1951 | Wood | 34/1 |
| 2,666,463 | 1/1954 | Heritage | 34/143 |
| 2,783,344 | 2/1957 | Warren | 219/10.81 |
| 2,783,347 | 2/1957 | Warren | 219/10.81 X |
| 2,871,332 | 1/1959 | Northmore et al. | 219/10.81 X |
| 3,721,013 | 3/1973 | Miller | 34/1 |
| 3,866,255 | 2/1975 | Serota | 219/10.81 X |

FOREIGN PATENTS OR APPLICATIONS

| | | | |
|---|---|---|---|
| 1,151,084 | 1/1958 | France | 219/10.81 |

*Primary Examiner*—Arthur T. Grimley
*Attorney, Agent, or Firm*—Eric P. Schellin

[57] ABSTRACT

The plant comprises two electrodes connected to a high-frequency generator and adapted to apply an electric field to the object to be heated. The first of the electrodes defines a space which is open on at least one of its sides and adapted to receive the object to be heated.

The second electrode is contained in a framework which is advantageously closed by shielding plates. The framework serves as a connection between the first of said electrodes and the high-frequency generator through contact shoes.

16 Claims, 3 Drawing Figures

PLANT FOR THE HEAT TREATMENT OF OBJECTS BY MEANS OF AN ELECTRIC FIELD

The present invention relates to the treatment of objects of wood and more particularly to a plant for subjecting objects of wood to a heat treatment, the heating being achieved by the high-frequency energy applied by electrodes.

In conventional plants of this type, there are usually employed two planar and parallel electrodes connected to the output terminals of a high-frequency generator by one of their ends. These electrodes thus form a capacitor whose dielectric is constituted by the wood to be treated. In the electric field produced by these electrodes there is usually observed certain irregularities due both to the position of the engaging point of the electrodes and to absorption or radiation phenomena. These irregularities in the field result in an uneven heating which gives uncertain results and reduces the efficiency.

An object of the present invention is to provide a plant for heat treating wood which does not have the drawbacks of the prior art.

According to the invention there is provided a plant for the heat treatment of objects of wood of the type comprising two electrodes connected to a high-frequency generator and adapted to apply an electric field to the object of wood to be heated, wherein a first of said electrodes defines a space which is open on at least one of its sides and adapted to receive the object to be treated and a second electrode closes this space, the assembly thus formed having a rectangular and substantially closed cross section.

With this arrangement, the object to be heated is surrounded at least on four sides by the electrodes so that it is possible to obtain an improved distribution of the electric field in the object.

Another object of the invention is to provide a press for the manufacture of objects of assembled strips of wood which employs the plant defined hereinbefore and permits in particular ensuring the drying or hardening of the adhesive for interconnecting the strips of the object to be formed.

Another object of the invention is to provide a method for heat treating objects by means of a high-frequency electric field generated by two electrodes between which electrodes the objects are disposed, wherein one of the electrodes has a longitudinal extent which is large with respect to the extent of the other electrode, the method comprising displacing said other electrode with respect to the first electrode in the course of the treatment of the objects.

Further features of the invention will be apparent from the ensuing description.

In the accompanying drawings, given solely by way of example:

Figure 1:
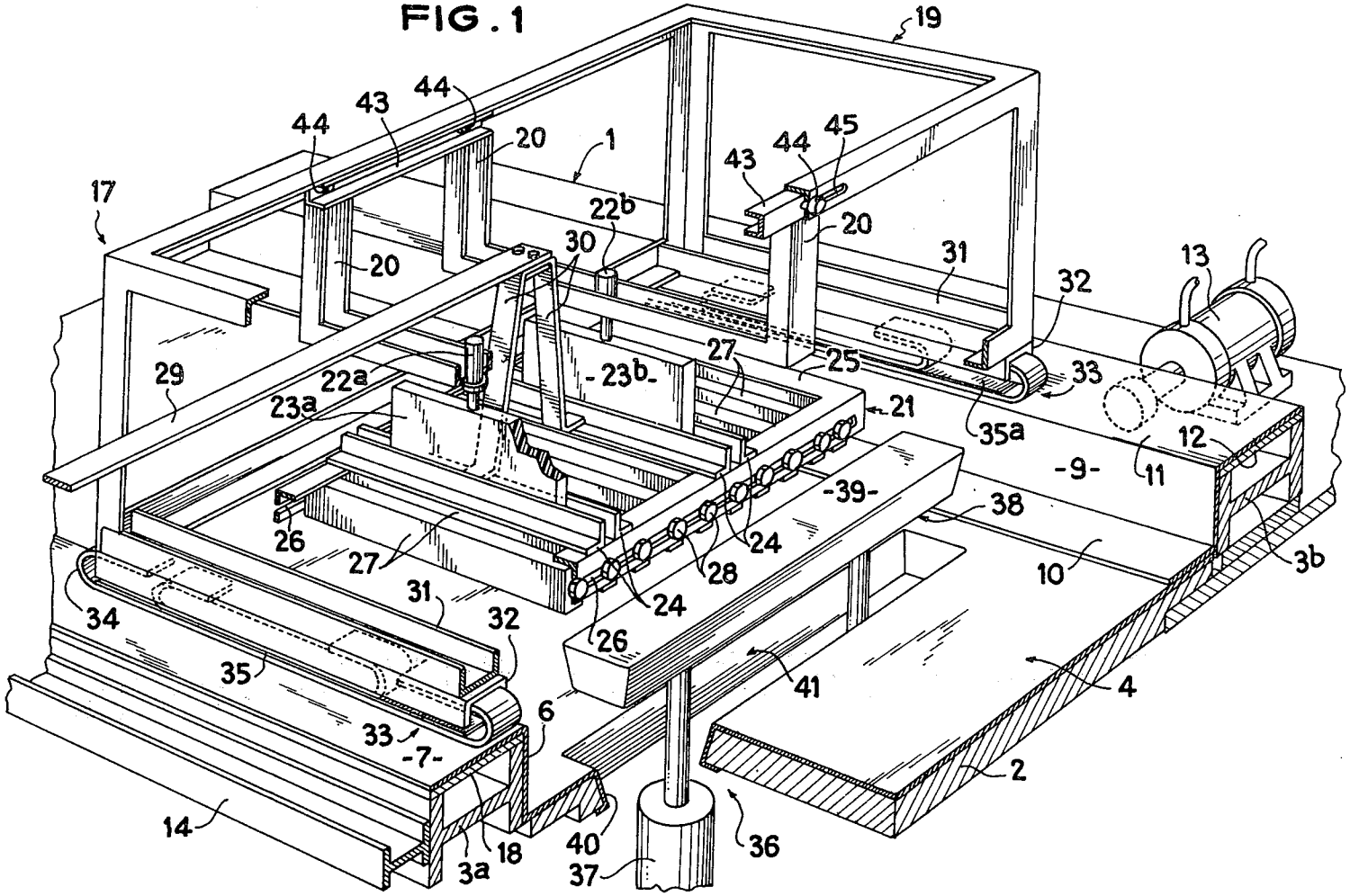
FIG. 1 is a perspective view, with a part cut away, of a treating plant according to the invention.

In the illustrated embodiment, the plant for treating objects of wood by means of an electric field comprises by way of example a press for manufacturing beams of assembled strips of wood.

The press comprises a frame 1 which carries an elongated plate 2 on the longitudinal sides of which are disposed metal H-section girders 3*a* and 3*b*.

A channel 4, preferably of aluminium sheet and constituting an electrode, is disposed between the girders 3*a* and 3*b*. It has a bottom 5 which is extended upwardly along one of its longitudinal edges by a vertical wall 6 which is folded horizontally so as to constitute a lateral flange 7. The wall 6 is applied against the corresponding girder 3 and the flange 7 bears on an elongated plate 8 secured to the girder 3.

On the opposite side, the channel 4 is defined by a lateral wall 9 which is movable in transverse translation with respect to the rest of the channel 4 and comprises a first horizontal flange 10 bearing on the bottom 5 of the channel and a second horizontal flange 11 which bears on the girder 3*b* through an interposed plate 12.

The assembly just described can be slid transversely with respect to the rest of the channel 4 by a plurality of jacks 13 only one of which is shown in the drawing, it being understood that the flange 10 remains in electric contact with the bottom 5 in all the positions that it can occupy in the course of its translation.

Two longitudinal runways 14 are secured to one of the sides of the frame 1 and act as a support for rollers 15 and 16 of a carriage 17 adapted to move alongside the channel 4 in the course of operation of the plant.

The carriage 17 carries a cabinet 18 in which there are disposed a high-frequency generator (not shown) of conventional type and the various controls of the plant. In this cabinet there is fixed a framework 9 of rectangular-sided shape which comprises a plurality of suitably assembled L-section members. This framework is constituted of a nonmagnetic material and has in particular two supports 20 from which there is suspended an electrode 21 through two vertical screwthreaded rods 22*a* and 22*b* respectively secured to two insulating vertical plates 23*a* and 23*b*. Each of the lower edge portions of these plates is clamped between two L-section members 24. The latter are secured to a rectangular frame 25 also constructed from L-section members.

The L-section members of the frame 25 which define the large sides thereof extend transversely of the channel 4 and they define a horizontal opening or slot 26 throughout their length.

Electrode bars 27 extend in a direction parallel to the small sides of the frame 25. They have at each end a screwthreaded aperture (not shown in the drawing) in which there is engaged a fixing screw 28 which extends through the corresponding slot 26.

With this arrangement it is possible to choose a required number of electrode bars and adjust the distance therebetween as desired.

The electrode 21 is connected to the generator 18 through a conductor 29 and two flexible connections 30 which are connected to the inner L-section member 24 of the electrode 21.

Two lower lateral cross-members 31 of the framework 19 are each integral with a U-section member 32 which supports a contact shoe 33. Each shoe comprises a first elastically yieldable strip 34 which is curved at its ends and secured by these ends to the member 32, and a second elastically yieldable support strip 35 fixed in the same manner to the member 32. Interposed between these two strips 34 and 35 is a thick plate of non-magnetic metal 35*a* which is integral with the strip 35 and serves to render the pressure uniform and avoid deformation of the elastically yieldable strip 34. The strips are composed preferably of bronze, of the "Crysocale" type, whereas the plate 35*a* is of for example "Dural". The shoes 33 ensure both the electric contact between the channel 4 and the ground of the plant and the support of the carriage 19 on the flanges 7 and 11 of the channel 4.

The plant also comprises an ejecting device 36 which includes two jacks 37 having vertical axes and bearing against the frame 1. The rods of these jacks are secured to a bar 38 of trapezoidal section covered with a sheet 39 on its upper face and lateral faces. This bar 38 adapts itself closely in an opening 49 formed in the bottom of the channel 4, the walls of this opening being covered with bent-down edge portions 41 of the bottom 5. These walls are oblique and are downwardly convergent so that when the bar 38 is in position, an intimate electric contact is achieved between the bottom 5 and the sheet 39.

Figures 2, 3:
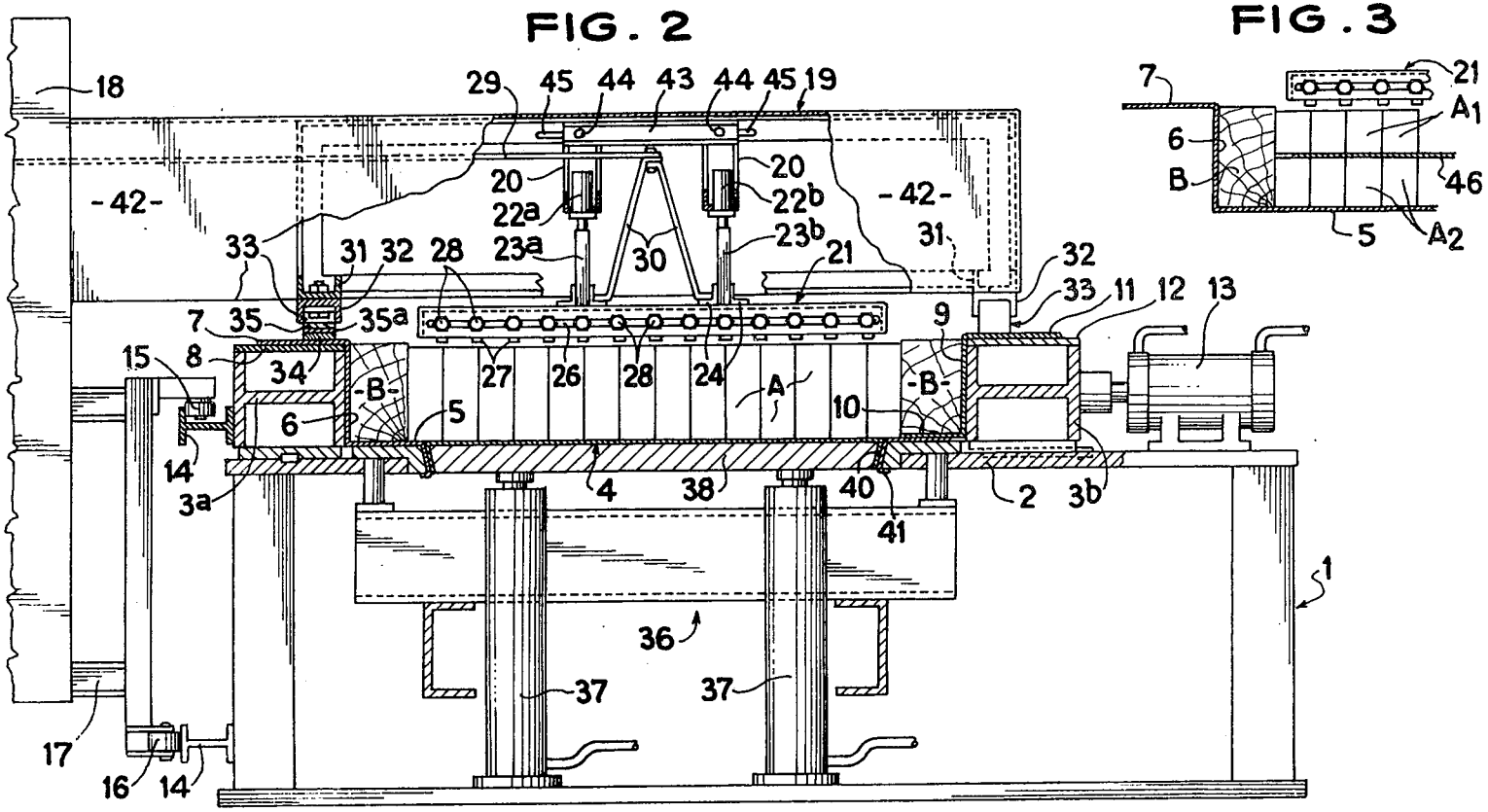
FIG. 2 is a sectional and elevational view of the plant shown in FIG. 1.
FIG. 3 is a partial sectional view and elevational view of a modification of the plant shown in FIGS. 1 and 2.

The framework 19 is closed by casing or shielding plates 42 (FIG. 2).

In the illustrated embodiment it can be seen that the plant according to the invention is employed as a press adapted to manufacture beams of assembled strips of wood.

FIG. 2 shows that the strips A which must constitute the beam are placed on edge on the bottom 5 of the channel 4 after having been previously coated with an adhesive. Blocks B of wood, which may be fixed to the channel 4, are disposed on each side of the strips A.

The position of the electrode 21 on the whole may be adjusted since the supports 20 are mounted on U-section members 43 which are secured to this framework by screws 44 extending through slots 45 which extend transversely of the channel 4. This adjustment permits in particular readjusting the positiion of the electrode 21 when the strips A are compressed by the jacks 13.

The illustrated press operates in the following manner:

The carriage 17 is first positioned at one end of the press so as to clear the channel 4. The strips A and the blocks B are then placed in position and the voltage is applied to the electrode 21 by the generator 18 after putting the jacks 13 under pressure so as to clamp the strips A together.

The carriage 17 is then made to travel at an adjustable predetermined speed and made to effect one travel above the channel so as to heat the adhesive between the strips by the high-frequency electric field which is created between the channel 4 and the electrode 21. At the end of its travel, the carriage 17 is stopped and disengaged from the channel 4. The pressure in the jacks is reversed and the beam obtained is then ejected by actuating the jacks 37.

The channel 4 constitutes the bottom and the two walls of the space which is covered by the electrode 21. Of course, in the illustrated embodiment, this space is movable since the electrode 21 moves with the carriage 19. The cross section of this space has a rectangular shape which is substantially closed, which results in an improved distribution of the electric field in the wood to be heated. The efficiency of the plant is thus much higher than in known plants.

The space formed by the channel 4 and the electrode 21 is open on two sides to allow passage for the strips of wood, the latter being capable of having a length distinctly greater than the transverse dimension of the electrode 21. It is possible in accordance with a modification and when it concerns a heating of objects of smaller dimensions, to provide instead of the channel 4 a dish-shaped base which would have four vertical walls to which the electrode 21 would be adapted. The treating space would than be fixed.

It can be seen from the foregoing that the objects of wood of elongated shape may be treated in a convenient manner owing to the elongated electrode 4 and to the fact that the other electrode 21 is movable above this elongated electrode 4 whose longitudinal extent is distinctly greater than the longitudinal extent of the electrode 21.

It is thought that the advantageous result obtained by the invention can be explained by the following points:

1. The effective or active region of the electrode 21 carrying voltage is located in the centre of the latter.
2. The region of the connection (walls 6 and 9) of the electrode to the ground (channel 4) is equidistant from the effective or active region of the electrode 21.
3. The grounding contracts (shoes 33) extend along a length at least equal to the width of the electrode 21.
4. The geometric centre of the active part of the channel 4 which is at a given moment under the electrode 21 is always equidistant from the grounding regions.

Another result is that the symmetry of the active elements of the electric circuit is maintained constant throughout the duration of a travel of the carriage 17 so that the distribution of the electric field remains uniform throughout the length of the objects to be heated.

A particular advantage is due to the fact that the electrode 21 has distinct bars 27 which may be disposed as desired. In particular, in the described embodiment, this enables such a bar to be disposed above each joint of adhesive so as to concentrate a part of the electric field therein. Moreover, the bars 27 are detachable and may be replaced by other elements constituting an electrode which do not necessarily have a rectilinear shape but could be adapted to the shape of the joint of adhesive to be heated.

Trials carried out have revealed a notable improvement in efficiency.

A beam 24 meters long comprising 33 strips of 9.5 × 3.2 cm section was treated within 50 minutes. These dimensions correspond to an area of adhesive of 73 sq. meters.

The effective high-frequency power was 22.5 kW, which corresponds to a power of 15.4 kW/m²/minute whereas known plants usually require a power in the neighbourhood of or equal to 24 kW/m²/minute. For the trails there was employed a ploymerizable adhesive known under the trade mark "Resorcine" (80% of adhesive and 20% of hardener).

It will be understood that the plant according to the invention may be employed for a treatment other than the drying of adhesive. For example, drying treatments could be carried out therewith. Moreover, objects may be treated which have shapes other than those of the rectilinear strips of wood just described. This plant may be employed, for example, for manufacturing panels of wood.

FIG. 3 shows that an metal separator 46 may be employed for separating two distinct layers $A_1$ and $A_2$ of wood strips. This separator ensures an improved distribution of the electric field.

Having now described my invention what I claim as new and desire to secure by Letters Patent is:

1. A plant for the heat treatment of objects comprising: a frame having an elongated shape, a high frequency generator having a pair of terminals supplied respectively with high voltage and constant ground potential, first electrode means fixedly mounted on said base and extending longitudinally thereof, said first electrode means having a bottom portion and side wall portions defining an elongated open space adapted to receive objects to be treated, second electrode means electrically insulated from said first electrode means and mounted on said frame so as to be movable along the length thereof, said second electrode means extending substantially in a plane located at the open side of said space so as to cover a part of the latter, a generally box-like shaped shielding structure containing at least a part of said second electrode means and being connected thereto by insulating means, said structure having an open side facing said open side of said space, and slidable contact means rigid with said structure and making electrical contact with said first electrode means, whereby said first and second electrode means are respectively connected to said pair of terminals of said generator.

2. A plant as claimed in claim 1, wherein said high frequency generator is movably mounted on said frame and carries said shielding structure, said first electrode means being connected to said terminal carrying said constant ground potential by means of said slidable contact means and said shielding structure.

3. A plant as claimed in claim 2, wherein said second electrode means is connected to said high voltage terminal of said generator at two symmetrical locations equidistant from ends of the second electrode means.

4. A plant as claimed in claim 3, wherein the second electrode means comprises a rectangular frame extending substantially in said plane located in the open side of said space and two cross-members which are also extending in said plane and slightly spaced apart and disposed on each side of a transverse median plane of said frame and secured to the frame, a conductor leading to the middle of the cross-member electrically connecting each cross-member to said high voltage terminal of said generator.

5. A plant as claimed in claim 2, wherein said first electrode means comprises a planar bottom, two walls perpendicular to the bottom, and a flange parallel to said bottom outwardly extending each wall, said slidable contact means comprising shoes being two in number and slidable along said flanges.

6. A plant as claimed in claim 5, wherein the second electrode means is fastened to said shielding structure by means allowing a transverse adjustment with respect to said first electrode means.

7. A plant as claimed in claim 5, wherein said shielding structure comprises a framework constituted by section members constituting a rectangular-sided body and shielding plates closing said body at all but one of its sides.

8. A plant as claimed in claim 5, wherein each shoe comprises a first elastically yieldable strip which has curved end portions secured to said shielding structures and a second elastically yieldable strip associated with the first strip and disposed between the first strip and the shielding structure, the second strip having curved end portions fixed to said shielding structure, a rigid plate being interposed between the two strips.

9. A plant as claimed in claim 5, wherein one of the walls of said first electrode means is movable in translation transversely of said first electrode means.

10. A plant as claimed in claim 9, wherein jack means are combined with said one of the walls of the first electrode means for moving it in translation.

11. A plant as claimed in claim 2, further comprising rail means extending along a longitudinal side of said frame and a carriage rolling on said rail means and carrying said generator.

12. A plant as claimed in claim 1, wherein the second electrode means comprises a plurality of electrode ars disposed in a direction to be parallel to the object to be treated and so arranged as to be adjustable perpendicularly to said direction.

13. A plant as claimed in claim 1, wherein said insulating means are insulating plates for mounting the second electrode means on the shielding structure, fastening means being provided for connecting the insulating plates to the shielding structure allowing an adjustment of the distance between said first and second electrode means.

14. A plant as claimed in claim 1, comprising an ejecting device including a bar and a metal sheet covering the bar, the bottom portion of the first electrode means having a complementary opening receiving the bar covered with the sheet and jack means being combined with the bar for raising the bar above the bottom portion.

15. A press for manufacturing objects of assembled strips of wood, comprising a plant for heating the objects and comprising: a frame having an elongated shape, a high frequency generator having a pair of terminals supplied respectively with high voltage and constant ground potential, first electrode means fixedly mounted on said base and extending longitudinally thereof, said first electrode means having a bottom portion and side wall portions defining an elongated open space adapted to receive objects to be treated, second electrode means electrically insulated from said first electrode means and mounted on said frame so as to be movable along the length thereof, said second electrode means extending substantially in a plane located at the open side of said space so as to cover a part of the latter, a generally box-like shaped shielding structure containing at least a part of said second electrode means and being connected thereto by insulating means, said structure having an open side facing said open side of said space, and slidable contact means rigid with said structure and making electrical contact with said first electrode means, whereby said first and second electrode means are respectively connected to said pair of terminals of said generator.

16. A press as claimed in claim 15, wherein for the purpose of adhering a plurality of layers of objects comprising assembled strips of wood there is provided an metal separator disposed between adjacent layers and formed by a metal plate which is connected to no source of voltage.

* * * * *